United States Patent [19]

Lee

[11] Patent Number: 5,007,848

[45] Date of Patent: Apr. 16, 1991

[54] MULTIPURPOSE SAFETY RECEPTACLE

[76] Inventor: Chiu-Shan Lee, No. 133-2, Lane 163, San Ho Rd., Section 4, San Chung City, Taipei Hsien, Taiwan

[21] Appl. No.: 388,876

[22] Filed: Aug. 3, 1989

[51] Int. Cl.[5] ..... H01R 13/652; H01R 27/00

[52] U.S. Cl. ..... 439/101; 439/222; 439/223; 439/651

[58] Field of Search ..... 439/92, 93, 101, 102, 439/106, 107, 217, 218, 221, 222, 223, 224, 536, 538, 540, 573, 650, 651, 652, 653, 682

[56] References Cited

U.S. PATENT DOCUMENTS

| | | | |
|---|---|---|---|
| 1,957,582 | 5/1934 | Elliott | 439/222 |
| 2,152,647 | 4/1939 | Hubbell, Jr. | 439/223 |
| 2,675,527 | 4/1954 | Hartranft | 439/650 |
| 3,441,896 | 4/1969 | Hawkins | 439/222 |
| 4,726,780 | 2/1988 | Thackeray | 439/223 |

*Primary Examiner*—Eugene F. Desmond
*Attorney, Agent, or Firm*—Lowe, Price, LeBlanc, Becker & Shur

[57] ABSTRACT

A multipurpose safety receptacle for alternative connection thereto of a variety of plug pins, which includes a bottom block comprising two receiving troughs at both lateral sides for receiving two conductive frames respectively, a ground connection trough in the middle for receiving a ground connection frame, a division plate mounted on the bottom block to enclose the conductive frames and the ground connection frame, and an upper cover covering over the division plate and fixedly connected with the bottom block by means of heat sealing process to form a receptacle assembly for further connection to a frame panel which frame panel is comprising retainer means and stop members to firmly hold up the receptacle assembly when the receptacle assembly is mounted thereon.

9 Claims, 9 Drawing Sheets

MULTIPURPOSE SAFETY RECEPTACLE

BACKGROUND OF THE INVENTION

Regular electric plugs, sockets or receptacles may vary in structure according to the power source available. The currently commercialized electric plugs, sockets, and receptacles may include single-phase double-line, single-phase three-line, three-phase three-line, and three-phase four-line, etc. Because the specifications assigned in a nation are different in the other, different structures may required for use in different country. For example, a single-phase double-line electric plug may comprise round pins or flat pins, and therefore, the receptacle used shall be constructed in accordance with the specification of the electric plug. More particularly, the electric plugs which have single-phase three-line or three-phase three-line may comprise two flat pins and one round pin, or three flat pins, or three round pins, . . . etc., and in consequence, different electric receptacles shall be used to match with the specifications of the electric plugs used. If the plug used does not match with the receptacle, the receptacle or the plug shall be changed, or an additional connector shall be used to connect the plug to the receptacle.

The present invention is related to a kind of multipurpose safety receptacle which is specifically designed to solve the above-said problems and is featuring in that:

1. The internal structure is specifically designed for alternatively connection thereto of a variety of electric plugs that are respectively used in all countries in the world;

2. By means of the design of the L-shaped pin holes of the upper cover matching with the arrangement of the division plate and spring leaves, electric shock can be protected, and the plug that has L-pins can be firmly retained when it is connected thereto;

3. It may be served as a connector for regular plug or receptacle;

4. It comprises retainer elements to firmly retain the electric wires without making any damage to the conductors or electric wires; and 5. Either single-core or multi-core conductors may be connected or replaced simply and efficiently.

SUMMARY OF THE INVENTION

The present invention is to provide a multipurpose safety receptacle and more particularly to a receptacle applicable for alternative connection thereto of a variety of plugs, which is including a bottom block two receiving troughs at both lateral sides for setting therein of two conductive frames, and a ground connection trough for setting therein of a ground connection frame, a division plate mounted on the top of the bottom block to enclose the conductive frames and the ground connection frame, and an upper cover covering over the bottom block and fixedly connected thereto by means of heat sealing process or adhesive or lock screws. When the bottom block is fixedly connected with the upper cover with the division plate, the conductive frames and the ground connection frame firmly positioned therein, the assembly is further mounted on a frame panel and firmly retained thereto by means of the retainer means and stop members of the frame panel.

BRIEF DESCRIPTION OF THE DRAWINGS

FIG. 3-1 is another sectional view of the embodiment of FIG. 1;

FIG. 4-1 is a back view of the frame panel according to the present invention;

FIG. 15-1 is a sectional view of the conductor fixture;

DETAILED DESCRIPTION OF THE PREFERRED EMBODIMENTS

Figure 1:
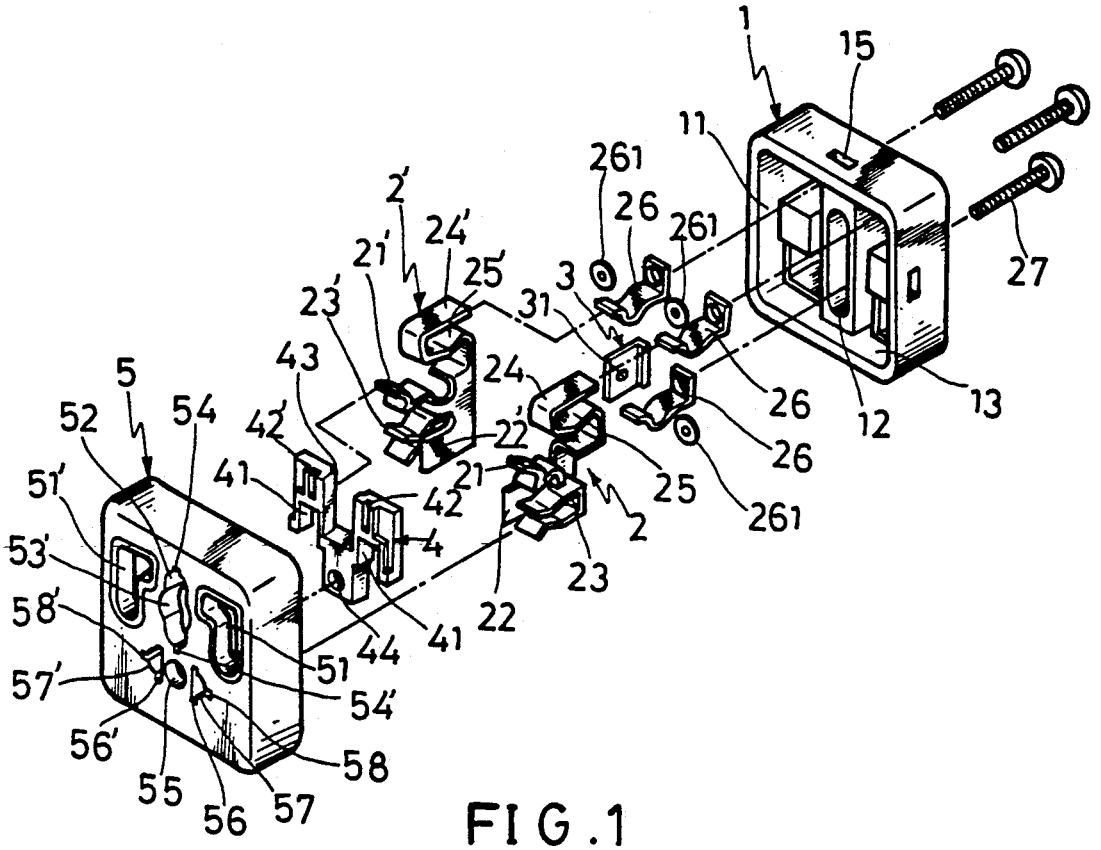
FIG. 1 is a perspective fragmentary view of a single outlet receptacle constructed according to the present invention.
Figure 2:
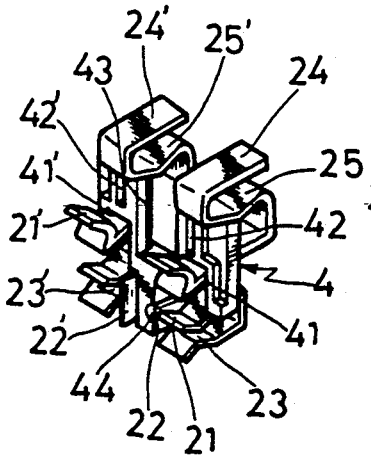
FIG. 2 is a perspective assembly view of the division plate with the two associated conductive frames according to the present invention.
Figure 3:
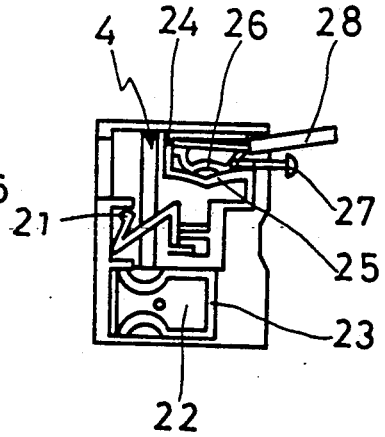
FIG. 3 is a sectional view of the embodiment of FIG. 1.
Figures 1, 3:
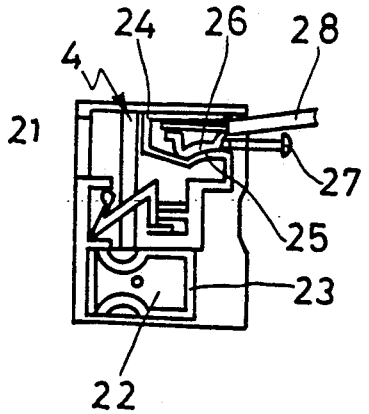

With reference to FIGS. 1, 2, 3 and 3-1, there is shown an example of single outlet receptacle constructed according to the present invention. The receptacle is including a bottom block (1) having two opposite troughs (11) and (13) for receiving therein conductive frames (2) and (2)' respectively, and a ground connection trough (12) for receiving therein a ground connection frame (3). The conductive frames (2) and (2)' are symmetrically disposed, comprising spring leaves (21) and (21)', receiving plates (22) and (22)', U-shaped conducting plates (23) and (23)', and U-shapes frames (24) and (24)'. The U-shaped frames (24) and (24)' are having corrugated tracks (25) and (25)' for setting therein of control plates (26) and (26)' respectively, wherein the control plates (26) and (26)' are respectively controlled by screw means (27) and (27)' to move forward or backward. When the control plates (26) and (26)' are moved forward, they are positioned on the top of the corrugated tracks (25) and (25)' respectively, having the hook ends (261) and (261)' firmly retaining the single-core conductors (28) which are respectively inserted therein. When the control plates (26) and (26)' are retreated by means of the screw means (27) and (27)' to move to a position beneath the corrugated tracks (25) and (25)', flexible multi-core conductors (not shown) may be respectively inserted therethrough and fixedly connected thereto when the screw means (27) and (27)' are respectively screwed up. Therefore, according to the present invention, either single-core or multi-core conductors may be simply connected to the receptacle. According to the present invention, the division plate (4) of the receptacle is including bilaterally two opposite guide rails (42) and (42)' and two opposite slots (41) and (41)', a notch (43), and a round hole (44). When in assembly, the conductive frames (2) and (2)' are respectively set in the troughs (11) and (13) of the bottom block (1), with the spring leaves (21) and (21)' of the conductive frames (2) and (2)' respectively set in the slots (41) and (41)' of the division plate (4), and the ground connection frame (3) is set between notch (43) and the round hole (44) and received in the ground connection trough (12) of the bottom block (1). According to the present invention, the upper cover (5) of the receptacle is including a pair of L-shaped pin holes (51) and (51) bilaterally disposed at the top, an oval hole (52) in the middle, a round hole (53) on the oval hole (52), two square holes (54) and (54)' set on the top and the lower end to respectively communicate with the oval hole (52), another round hole (55) set at a lower position below the oval hole (52), and a pair of openings symmetrically set at both lateral sides of the round hole (55), which pair of openings are comprised of elongated holes (56) and (56)', round holes (57) and (57)', and square holes (58) and (58)' respectively. As soon as the upper cover (5), division plate (4), conductive frames (2) and (2)', ground connection frame (3), and bottom block (1) and the related accessories are coupled together, they are further fixedly connected by means of heat sealing or adhesive or screw means to form a multipurpose safety receptacle. Please refer to FIGS. 4 and 4-1, the multipurpose safety receptacle constructed as above described may be further mounted on a frame panel (7). The frame panel (7) is having four pieces of stop members (71) and a pair of retainer means (72). When the receptacle is mounted on the frame panel (7), the stop members (71) are arranged to stop against the receptacle at the back side and the retainer means (72) are having the projecting portions (73) respectively set in the retaining holes (15) of the bottom block (1) to let the receptacle be firmly positioned. Because the receptacle has a square structure, it may be set at any position. When the retainer means (72) are flexibly bending outward, the receptacle may be easily pushed outward to detach from the frame panel (7).

Figure 5:
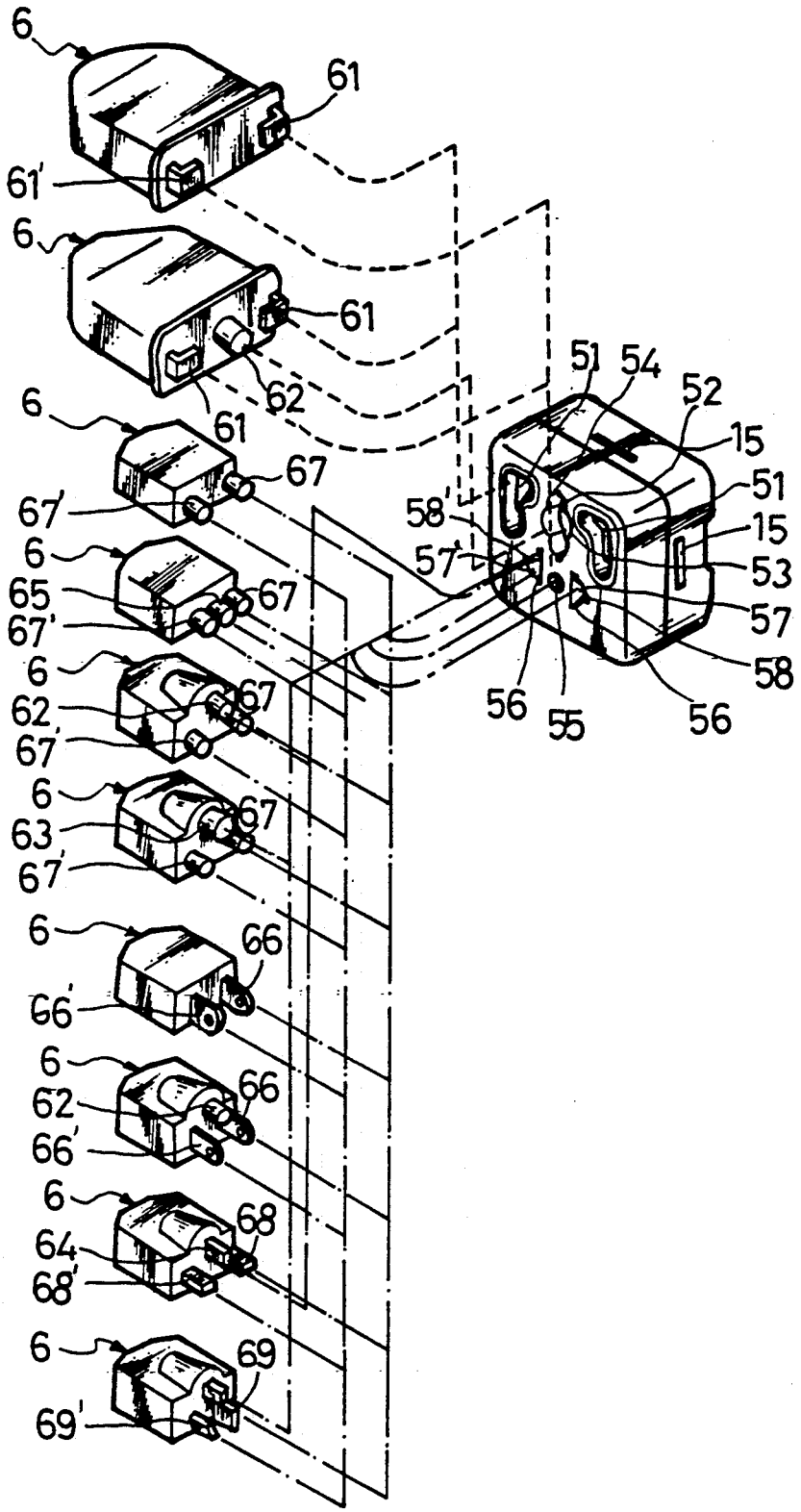
FIG. 5 is an operational schematic view, illustrating the application of the present invention.
Figure 10:
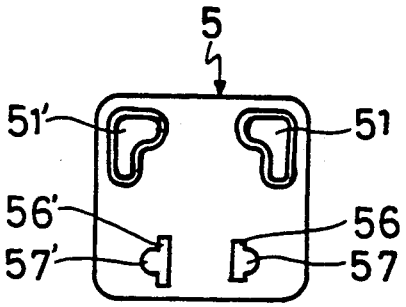
FIG. 10 illustrates a yet another embodiment of multipurpose safety upper cover constructed according to the present invention.

Referring to FIG. 5 and considering FIGS. 1 and 2 again, a plug (6) which is having L-pins (61) and (61)' may be utilized. When in operation, the L-pins (61) and (61)' are respectively inserted into the L-shaped pin holes (51) and (51)'. When the L-pins (61) and (61)' are in contact with the division plate (4), the electric power is still not connected unless the L-pins (61) and (61)' have been continuously forced to move downward along the guide rails (42) and (42) to become in contact with the spring leaves (21) and (21)'. Therefore, the present invention can protect against electric shock during connection. Because of the special electric shock preventive design and because of the arrangement of the hook ends of the control plates, the present invention becomes very practical for use to serve as wall lamp extension receptacle, electric bell extension receptacle, . . . etc.

Figure 6:
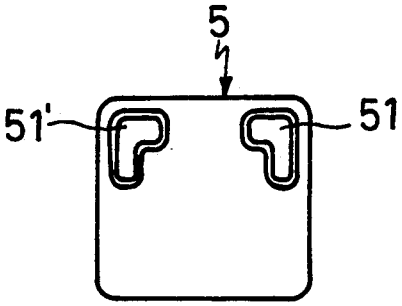
FIG. 6 illustrates a safety upper cover constructed according to the present invention.
Figure 11:
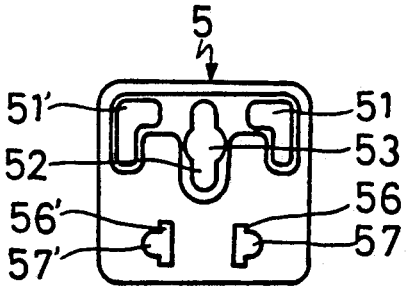
FIG. 11 illustrates a further embodiment of multipurpose safety upper cover constructed according to the present invention.
Figure 7:
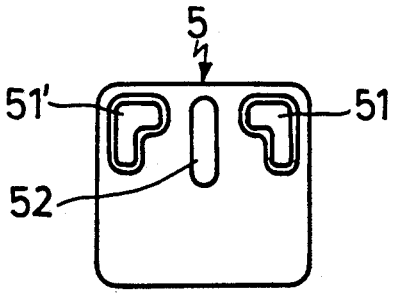
FIG. 7 illustrates another embodiment of safety upper cover constructed according to the present invention.
Figure 12:
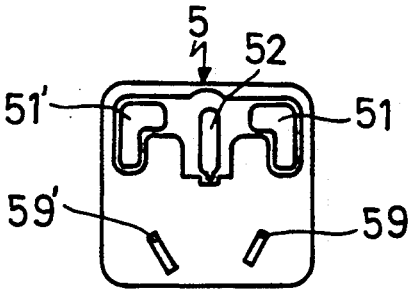
FIG. 12 illustrates another further embodiment of multipurpose safety upper cover constructed according to the present invention.
Figure 8:
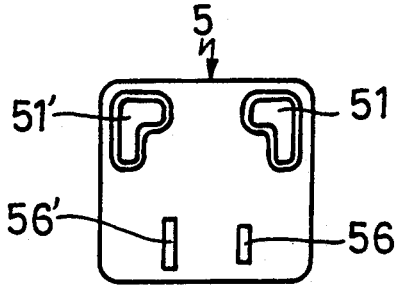
FIG. 8 illustrates a multipurpose safety upper cover constructed according to the present invention.
Figure 13:
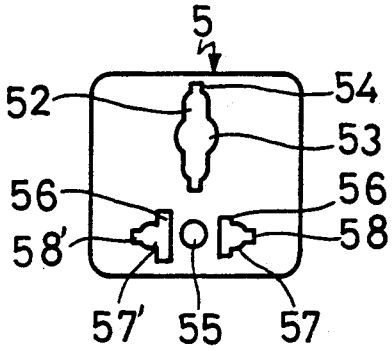
FIG. 13 illustrates a yet further embodiment of multipurpose safety upper cover constructed according to the present invention.
Figure 9:
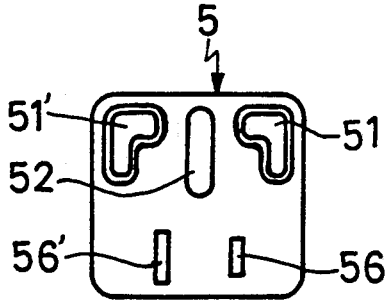
FIG. 9 illustrates another embodiment of multipurpose safety upper cover constructed according to the present invention.

The second type of plug (6) which is having a round pin (62) in the middle may also be used for connection with the receptacle constructed according to the above-described specification. The round pin (62) may be inserted into the oval hole (52) to connect with the ground connection frame (3), and the bilateral two round pins (67) and (67)' may be respectively inserted into the round holes (57) and (57)'. If a plug has three round pins arranged in a row, the middle round pin may be inserted into the round hole (55). If a plug has three round pins arranged in triangular position, in which the middle round pin (63) has an extra large size, thus, the middle round pin (63) may be inserted through the round hole (53) into the curved portion (31) of the ground connection frame (3). If a plug (6) includes two flat pins (66) and (66)', the two flat pins (66) and (66)' may be inserted into the elongated holes (56) and (56)' respectively. If a plug (6) has square pins (64), (68) and (68)', the square pins (64), (68) and (68)' may be inserted into the square holes (54), (58) and (58)' respectively. Therefore, the receptacle constructed according to the present invention is specifically designed to match with the variety of plugs which are commonly used in all countries in the world. According to the present invention, there is a gap respectively defined between the receiving plates (22) and (22)' and the U-shaped conducting plates (23) and (23)' of the conductive frame (2), such that when plug pins are inserted, the plug pins will be respectively in contact with the receiving plates (22) and (22)' at an slightly inclined angle. Through this special arrangement, the service life can be reasonably extended. Further, the U-shaped conducting plates (23) and (23)' each is having a smaller front end and a relatively larger rear end to make the structure more flexible so as to efficiently receive either round plug pins or square plug pins. Therefore, there are a variety of upper covers (5) constructed according to the present invention which comprise different plug holes for connection of different plug pins (see FIGS. 6–13). The upper cover (5), as shown in FIGS. 6 and 7, which is having two opposite L-shaped pin holes (51) and (51)' and a middle oval pin hole (52) for ground connection is providing electric shock preventive effect and helps to have the connected plug pins be firmly retained therein. FIG. 12 illustrates another upper cover structure which comprises bevelly disposed elongated pin holes (59) and (59)' for connection thereto of the plug which has bevelly disposed plug pins.

Figure 14:
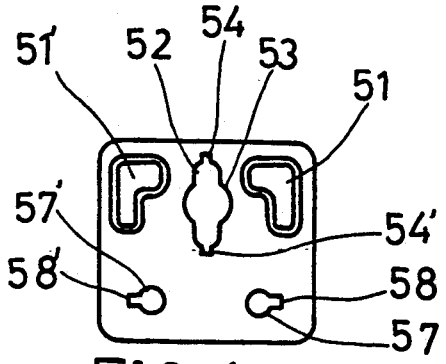
FIG. 14 is a perspective fragmentary view of a multi-outlet extension receptacle constructed according to the present invention.
Figure 15:
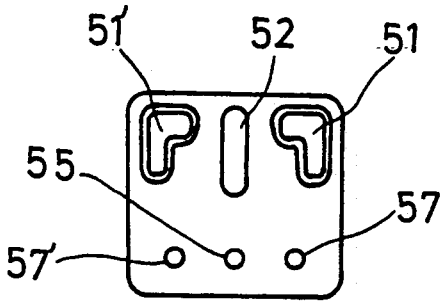
FIG. 15 is a partly sectional view of the embodiment of FIG. 14.
Figure 16:
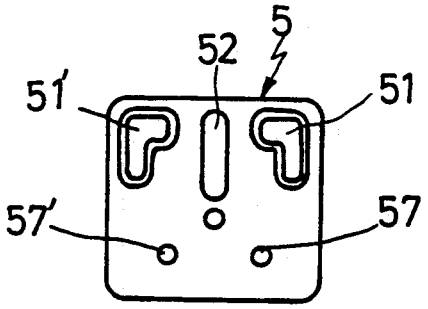
FIG. 16 is a perspective view of multi-outlet extension line receptacle according to the present invention.

With reference to FIGS. 14, 15 and 16, there is shown a multi-outlet receptacle (100) constructed according to the present invention, which is mainly including a bottom block (110), two conductive frames (120) and (120)', a ground connection frame (130), a division plate (140), and an upper cover (150). The bottom block (110) is having two receiving troughs (111) and (113) and a ground connection trough (112). The conductive frames (120) and (120)' are symmetrically disposed. Similar to the structure of the conductive frames (2) and (2)' as illustrated in FIG. 1, the conductive frame (120) and (120)' are including spring leaves (121) and (121)', receiving plates (122) and (122)', U-shaped conducting plates (123) and (123)', and pressure plates (124) and (124)'. When in assembly, the U-shaped conducting plates (123) and (123)' are respectively set in the U-shaped troughs (114) and (114)', the receiving plates (122) and (122)' are respectively set in the slopes (115) and (115)', the pressure plates (124) and (124)' are respectively mounted on the supporting stands (114) and (114)'. When the conductive frames (120) and (120)' are respectively received in the receiving troughs (111) and (113) and firmly positioned therein and covered by the division plate (140), the spring leaves (121) and (121)' are protruding beyond the division plate (140) through the holes (142) and (142)' respectively. The L-shaped holes (141) and (141)' of the division plate (140) are served for electric shock preventive purpose only, while the holes (143) and (143)' of the division plate (140) are arranged for penetration therethrough of the receiving plates (122) and (122)' and the U-shaped conducting plates (123) and (123)', and the elongated hole (144) and round hole (145) are for insertion therein of ground connection plug pins respectively. According to the present invention, the ground connection frame (130) is including bevel notches (131) for connection thereto of big ground connection pins respectively, and bevel side edge (132) for connection thereto of round plug pins through single side connection. Similar to the embodiment before described, the upper cover (150) is comprising L-shaped pin holes (151) and (151)', oval pin holes (152), round pin holes (153), square pin holes (154), (154)', (158) and (158)', elongated pin holes (156) and (156)', and round holes (157) and (157)'. The upper cover (150) may be used for connection thereto of a variety of plugs in same procedures as previously described. According to the present invention, the conductive frames (120) and (120)' and the ground connection frame (130) each is having a conductor fixture (125) for fixation thereto of respective conductors. The conductor fixture (125) is integrally incorporated with the conductive frame (120), comprising a wire hole (126), a screw means (127) and a notch (128). When a conductor is inserted, it is clearly viewed through the notch (128) and fixedly connected thereto by means of the screw mean (127). The structure of the conductor fixture of the conductive frame (120)' as well as the ground connection frame (130) is just same as the conductive frame (120). As shown in FIGS. 15 and 15-1, the bottom block (110) is also comprising a conductor fixture (160), which is having a rectangular body comprising hole (161), screw means (162), pressure block (163), and notch (164). When a conductor (165) is inserted through the hole (161), the pressure block (163) is driven by the screw means (162) to press down the conductor (165) toward the notch (164) and the conductor (165) will be immediately bent into a curved shape and firmly positioned therein.

Figure 17:
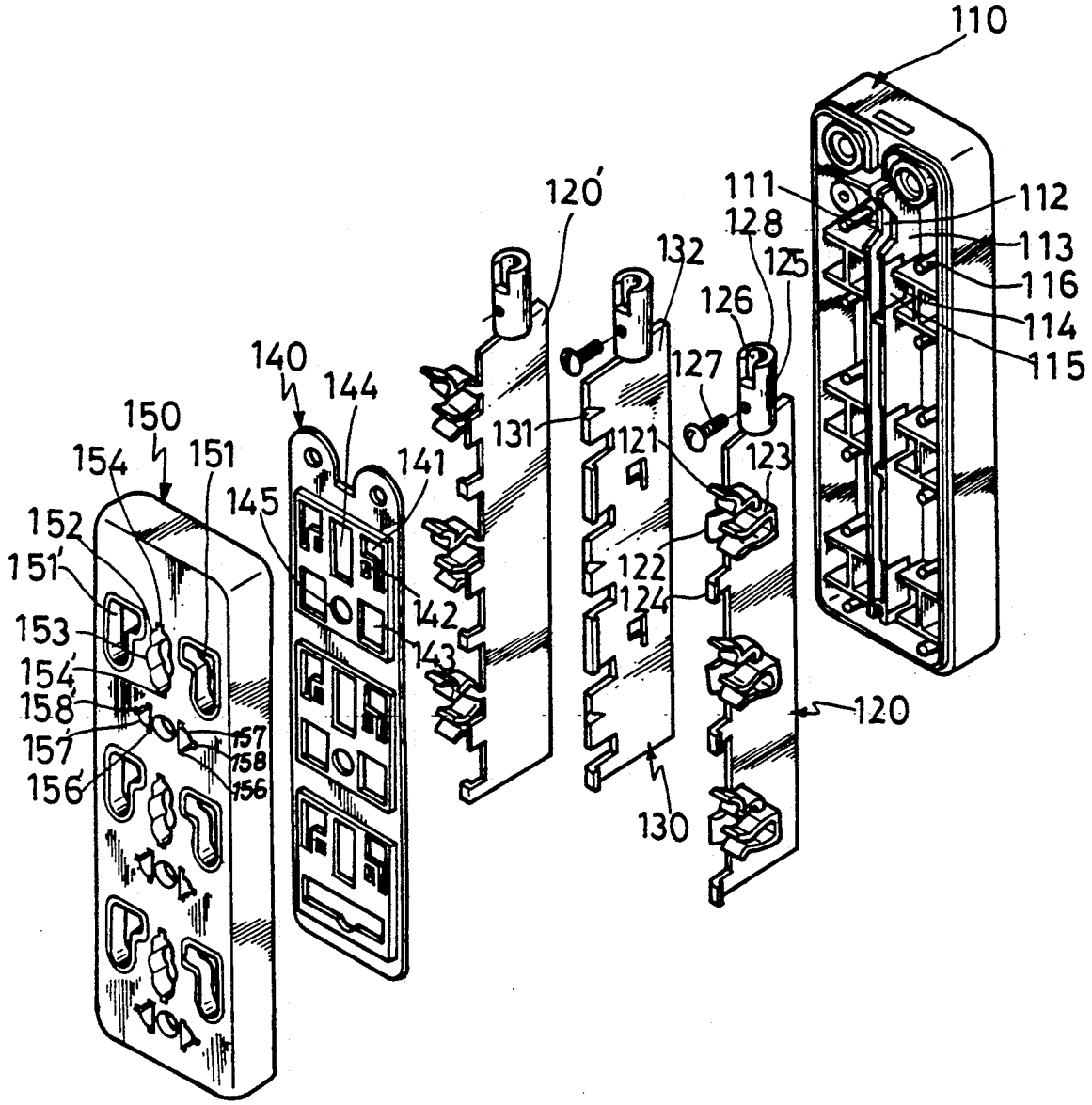
FIG. 17 is a partly fragmentary view of a multi-outlet extension line receptacle according to the present invention, which is comprising a plug assembly.
Figure 18:
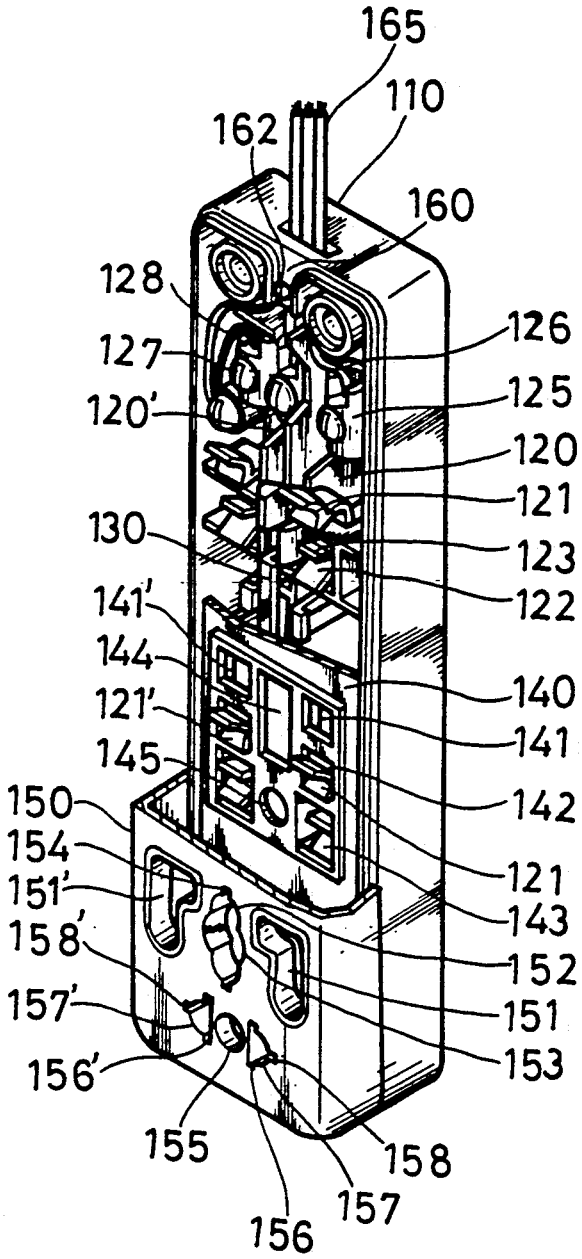
FIG. 18 is a schematic drawing of the present invention, illustrating the application of a plug assembly incorporated multi-outlet extension line receptacle alternatively matching with different extension line assembly.
Figures 1, 18:
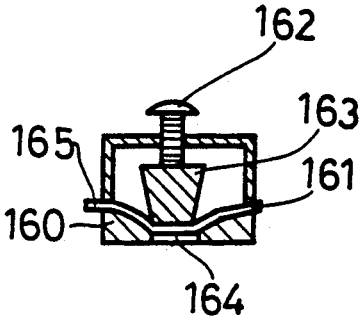

With reference to FIGS. 17 and 18, the multi-outlet receptable (100) may be incorporated with a plug assembly. As shown in the drawings, metal contact plates (170), (170)' and (180) are mounted on the bottom block (110) to respectively connect with the conductive frames (120) and (120)' and the ground connection frame (130) at one end. The metal contact plates (170), (170)' and (180) which are comprising holes (171), (171)' and (181), and several indentations (172), (172)' and (182), are respectively arranged to match with the holes (174), (174)' and (184), and several noses (175), (175)' and (185) of L-shaped plug pins (173), (173)' and (183), which L-shaped plug pins (173), (173)' and (183) are respectively connected to the metal contact plates (170), (170)' and (180) by means of lock pins (176), (176)' and (186). When the metal contact plates (170), (170)' and (180) and the L-shaped pins (173), (173)' and (183) are fixedly connected, a plug socket (190) and a plug cover (191) are further mounted on the bottom block (110) to firmly hold up the L-shaped plug pins (173), (173)' and (183) by means of screw means (192) and (192)'. Through the said arrangement, a multipurpose, multi-outlet and plug incorporated safety receptacle is thus achieved. Please refer to FIG. 18 again, the plug socket (190) is having a recess (193) made on the front side wall to match with the nose (313) of the receptacle (310) of the extension line assembly (300) for quick connection. The receptacle (310) of the extension line assembly (300), similar to the embodiment of the receptacle illustrated in FIG. 1, is having L-shaped pin holes (351) and (351)' and oval pin hole (352), while the plug (320) of the extension line assembly (300) is having two L-pins (321) and (321)', a ground connection pin (322) and a recess (323). As an alternate form, the plug (320) may have different plug pins for different purpose.

Figure 19:
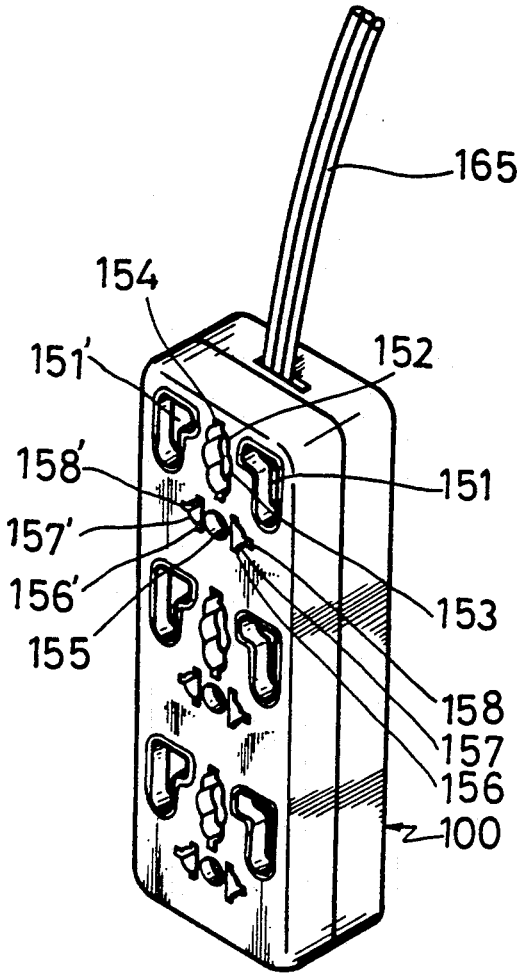
FIG. 19 is a schematic drawing, illustrating the positioning of a receptacle according to the present invention.

With reference to FIG. 19, the multi-outlet receptacle, according to the present invention, is having unique structure for quick positioning. As shown in the drawing, a hole (410) is made on the bottom surface of the receptacle for hanging of the receptacle. A positioning plate (420) which is comprising a hole (421) at one end and another hole (422) at the opposite end is revolvably connected, by means of a screw means (430) through the hole (421), to the receptacle at the bottom opposite to the hole (410). When to fix the receptacle onto a wall (500), the receptacle (400) is hung on the nail (510) of the wall (500) by means of its hole (410), and the positioning plate (420) is turning downward and fixedly connected to the wall (500) by means of screw means (520) through the hole (422). According to the present invention, when the receptacle (400) is not in use, the positioning plate (420) is received in the recess (440), or the positioning plate (420) may be turned outward for connection when it is in use.

Figure 20:
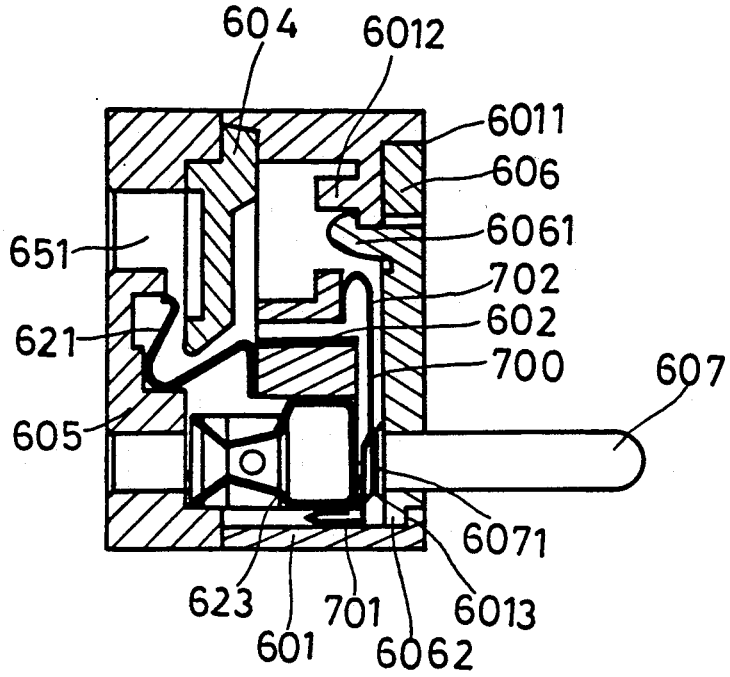
FIG. 20 is a perspective fragmentary view of another embodiment of multi-outlet extension line receptacle according to the present invention.
Figure 21:
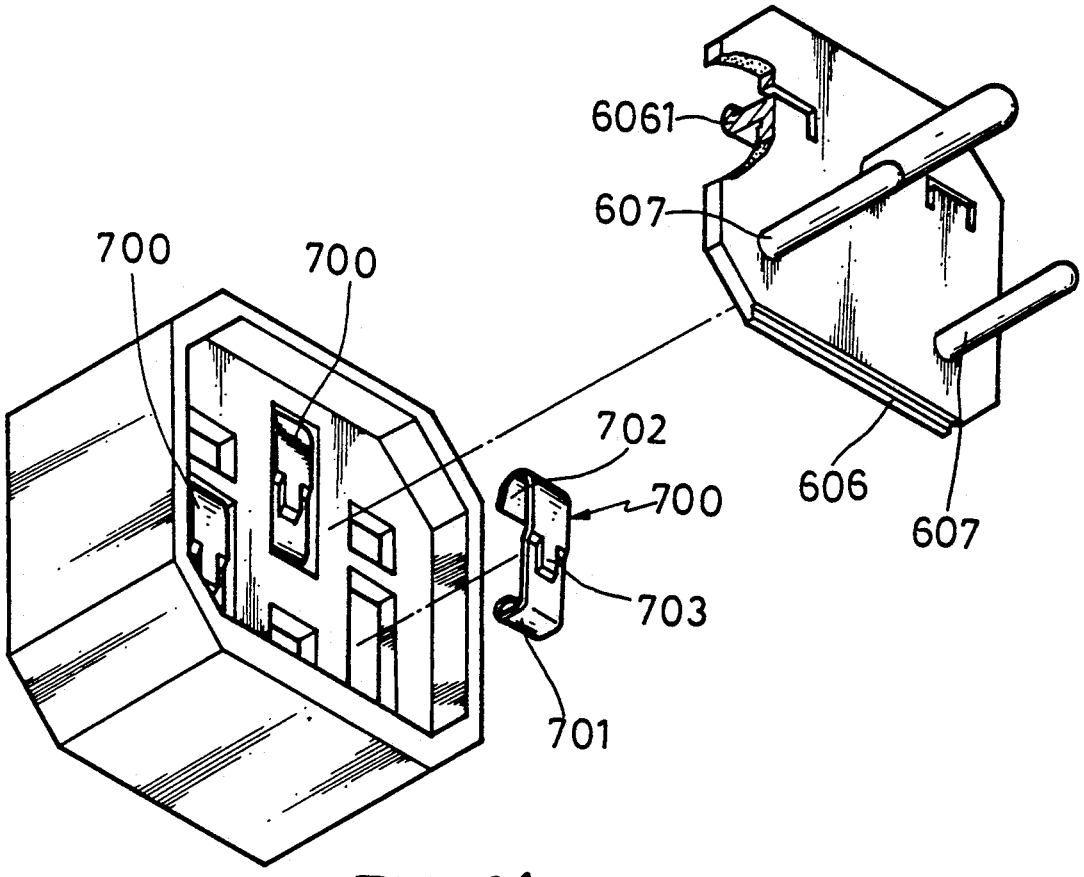
FIG. 21 is a perspective view of the embodiment of FIG. 20.

FIGS. 20 and 21 illustrate another embodiment of multi-outlet receptacle according to the present invention. Similar to the embodiment as shown in FIG. 14, the receptacle (200) is having a bottom block, two conductive frames (220) and (220)', a ground connection frame (230), a division plate (240) and an upper cover (250), wherein the U-shaped conducting plates (223) and (223)' of the conductive frames (220) and (220)' are slightly inclined to respectively match with the bevelly disposed elongated pin holes (259) and (259)' of the upper cover (250).

Figure 4:
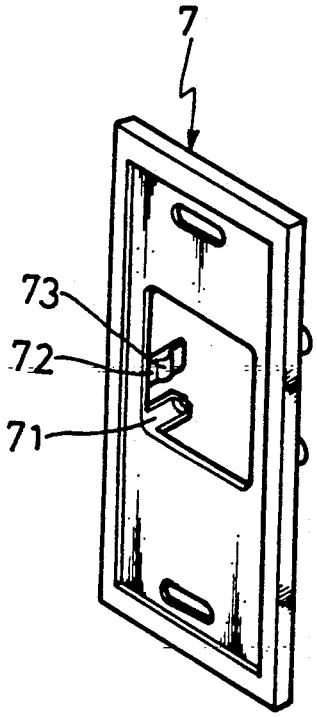
FIG. 4 is a perspective view of the frame panel according to the present invention.
Figures 1, 4:
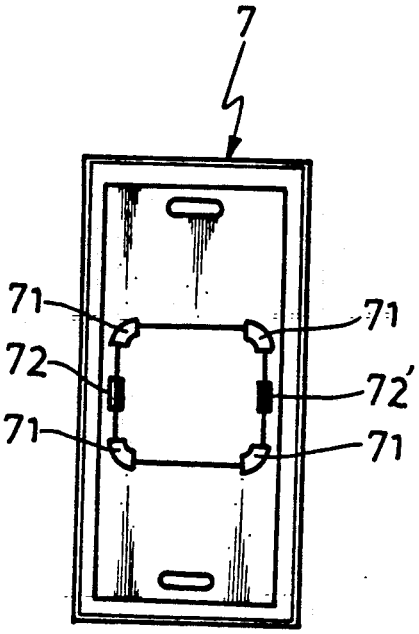

According to the present invention, the single outlet type receptacle as illustrated in FIG. 1 may be connected to the retainer means (72) of the frame panel (7) as illustrated in FIG. 4. When the present invention is to be served as a plug connector, the receptacle disclosed in FIG. 1 may alternatively comprise at the rear end the ten different plug pins as illustrated in FIG. 5 while the front end receptacle structure remains unchanged, so as to serve as a multipurpose plug connector.

I claim:

1. A multipurpose safety receptacle including:

an upper cover comprising a pair of L-shaped pin holes bilaterally disposed at the top, an oval hole in the middle, a first round hole in the oval hole, two square holes set on the top and the lower end respectively of said oval hole, a second round hole set at a lower position below said oval hole, and a pair of openings each symmetrically set at a side of the second round hole, said pair of openings each being comprised of an elongated hole, a round hole and a square hole;

a division plate comprising bilaterally two opposite guide rails and two opposite slots, and a notch and a round hole in the middle;

a bottom block having two receiving troughs spaced apart laterally from each other and a ground connection trough disposed between said receiving troughs, and a plurality of retaining holes spaced around the periphery of said block;

two conductive frames being respectively set in said two receiving troughs of said bottom block, each comprising a spring leaf, a receiving plate, an U-shaped conducting plate, an U-shaped frame, said U-shaped frame comprising a corrugated track for setting therein of a control plate;

a ground connection frame having slightly inclined top end vertically bending downward to define a curved portion at both lateral sides for easy connection thereto of ground connection pins of different size;

characterized in that when a plug which has L-pins is connected thereto the L-pins are inserted to contact said guide rails of said division plate and further moved downward to contact said spring leaves of said conductive frames to let electric power be connected; when a plug which has flat plug pins is connected thereto the flat plug pins are inserted to set in between said receiving plates and said U-shaped conducting plates and to get connected with said receiving plates and said U-shaped conductive plates so as to let electric power be connected; when a plug which has two round plug pins or square plug pins is connected thereto the plug pins are inserted therein to set in said U-shaped conducting plates to let electric power be connected.

2. The multipurpose safety receptacle according to claim 1, wherein said L-shaped pin holes of said upper cover are arranged to match with said division plate and said spring leaves of said conductive frames to form a safety receptacle structure such that when a plug which has L-shaped plug pins is connected thereto the electric power is still not connected upon insertion of the L-shaped plug pins unless the L-shaped plug pins have been continuously forced to move downward along said guide rails to contact said spring leaves, so as to protect against electric shock during connection.

3. The multipurpose safety receptacle according to claim 1, wherein said conductive frames each comprises a U-shaped frame including a corrugated track, a control plate, mounted in said track, and screw means coupled to said plate for moving said plate along the associated corrugated track to control the positioning of a conductor.

4. The multipurpose safety receptacle according to claim 1, wherein said U-shaped conducting plates are slightly bevelly disposed to match with the symmetrical openings on said upper cover.

5. The multipurpose safety receptacle according to claim 1, wherein the receptacle structure further comprises a plug assembly to serve as an extension line receptacle said plug assembly comprising metal contact plates respectively connected with said conductive frames and said ground connection frame at one end, and also respectively connected with L-shaped plug pins at the other end.

6. The multipurpose safety receptacle according to claim 1, wherein said bottom block defines a hanging hole on the bottom surface of said bottom block for hanging the receptacle, and a positioning plate revolvably mounted on the bottom surface of the bottom block of the receptacle opposite to the hanging hole whereby a screw means for fixation of said receptacle onto wall surface can be used to mount said receptacle.

7. The multipurpose safety receptacle of claim 1 further comprising: a frame panel comprising four pieces of stop members and a pair of retainer means said retainer means each comprising a projective portion for mounting said receptacle therein.

8. The multipurpose safety receptacle according to claim 1, wherein each conductive frame further comprises a conductor fixture having hole for insertion therethrough of a conductor and having means for connecting a conductor inserted through the hole thereto.

9. The multipurpose safety receptacle according to claim 8, wherein said means for connecting further comprising a pressure block and screw means for controlling said pressure block to press on a conductor when one is inserted through the hole so as to press the conductor into a curved shape retained in said frame.

* * * * *